US008357055B2

(12) United States Patent
Yatsuda

(10) Patent No.: US 8,357,055 B2
(45) Date of Patent: Jan. 22, 2013

(54) GOLF CLUB SHAFT, PRODUCTION METHOD THEREFOR, AND GOLF CLUB THEREWITH

(75) Inventor: Naruki Yatsuda, Yokohama (JP)

(73) Assignee: NHK Spring Co., Ltd., Kanagawa (JP)

( * ) Notice: Subject to any disclaimer, the term of this patent is extended or adjusted under 35 U.S.C. 154(b) by 110 days.

(21) Appl. No.: 12/453,666

(22) Filed: May 18, 2009

(65) Prior Publication Data

US 2009/0298608 A1 Dec. 3, 2009

(30) Foreign Application Priority Data

May 28, 2008 (JP) ..... 2008-139451

(51) Int. Cl.
*A63B 53/12* (2006.01)

(52) U.S. Cl. ..... 473/316

(58) Field of Classification Search ..... 473/316, 473/282; 205/180
See application file for complete search history.

(56) References Cited

U.S. PATENT DOCUMENTS 5,374,064 A * 12/1994 Barber ..... 473/204
5,935,018 A 8/1999 Takeda
6,073,979 A * 6/2000 Nawalaniec et al. ..... 292/256
6,346,052 B1 * 2/2002 Chappell ..... 473/324
7,607,989 B2 * 10/2009 Hess et al. ..... 473/282
2004/0014533 A1 * 1/2004 Joo et al. ..... 473/340
2008/0242443 A1 * 10/2008 Gilbert et al. ..... 473/331

FOREIGN PATENT DOCUMENTS

JP 10-265991 10/1998
JP 11-267254 10/1999
JP A-2002-362099 12/2002
JP 2003-293198 10/2003
JP 2007-029276 2/2007

OTHER PUBLICATIONS

Japanese Office Action issued Jun. 18, 2012; Application No. 2008-139451.

* cited by examiner

*Primary Examiner* — Michael Dennis

(74) *Attorney, Agent, or Firm* — Antonelli, Terry, Stout & Kraus, LLP.

(57) ABSTRACT

A golf club shaft includes a base made of a metal material, a nickel plated layer formed on the base, a chrome plated layer formed on the nickel layer, and a coating layer formed on the chrome plated layer. The chrome plated layer has a surface roughness Ra of 0.1 to 0.3 μm and a thickness of 0.2 to 1 μm.

8 Claims, 6 Drawing Sheets

| Ejection pressure | Surface roughness (Ra) | Evenness | Coating strength |
|---|---|---|---|
| 1.0 kg | 0.055 | Unsatisfactory | Unsatisfactory |
| 1.5 kg | 0.124 | Satisfactory | Satisfactory |
| 2.0 kg | 0.192 | Satisfactory | Satisfactory |
| 2.5 kg | 0.261 | Satisfactory | Satisfactory |
| 3.0 kg | 0.330 | Unsatisfactory | Satisfactory |
| 4.0 kg | 0.467 | Unsatisfactory | Satisfactory |

GOLF CLUB SHAFT, PRODUCTION METHOD THEREFOR, AND GOLF CLUB THEREWITH

BACKGROUND OF THE INVENTION

1. Technical Field

The present invention relates to a metal golf club shaft, to a method of producing the golf club shaft, and to a golf club with the golf club shaft.

2. Background Art

As a technique for improving the design of a metal golf club shaft, a technique of coating the surface of a shaft is known (for example, see Japanese Patent Application Laid-Open No. 2002-362099).

In general, when a coating is directly applied to a metal golf club shaft, adequate coating strength may be obtained, but rusting may occur at areas at which the coating peels off. This rusting may cause damage to the shaft if the corrosion expands from such areas, and therefore, rusting is undesirable.

As a technique for preventing generation of corrosion, a method of forming a plated layer and further coating the plated layer may be mentioned, and the plated layer functions as a corrosion-resistant layer. A plated layer obtained by forming a nickel layer and forming a chrome layer thereon is effective as the plated layer. The nickel layer increases adhesion of the chrome layer with respect to the surface of the base metal shaft, and the nickel layer has sealing characteristics for preventing moisture from penetrating to the base metal shaft. The chrome layer functions as a hard layer for protecting the surface and also functions as a layer exhibiting a metallic luster.

According to this structure, even when the coating peels off, rusting can be prevented due to the plated layer. In addition, a scratch-resistant surface is obtained, and a metallic luster is obtained. However, when coating is applied after a plated layer is formed, the coating strength is low, and the coating may easily peel off.

As a method for improving the coating strength, the following method may be used. In this method, after a plated layer is formed, the surface of the plated layer is ground so as to roughen the surface, thereby improving adhesion of the coating. In this case, the coating strength is improved compared to that in a case in which grinding is not performed, but the degree of coating strength is insufficient for the degree of coating strength required for golf club shafts.

SUMMARY OF THE INVENTION

In view of these circumstances, an object of the present invention is to provide a technique for securing high coating strength in a structure in which a nickel layer and a chrome layer are formed on a surface of a metal golf club shaft and a coating is applied thereon.

In a first aspect of the present invention, the present invention provides a golf club shaft including a base made of a metal material, a nickel plated layer formed on the base, a chrome plated layer formed on the nickel layer, and a coating layer formed on the chrome plated layer. The chrome plated layer has a surface roughness Ra of 0.1 to 0.3 μm and a thickness of 0.2 to 1 μm.

According to the first aspect of the present invention, an uniform metallic luster that is clear and bright is obtained by the plated layers at a portion which is not colored by the coating. Moreover, a golf club shaft having a coating layer with a high degree of adhesion is obtained. Even when the coating peels off, since the layer below the coating layer is the chrome plated layer having a high film strength, and the layer below the chrome plated layer is the nickel plated layer functioning as a corrosion-resistant layer, rusting is prevented.

In the first aspect of the present invention, if the surface roughness Ra of the chrome plated layer is less than 0.1 μm, the surface of the plated layers exhibits an uneven metallic luster, and the coating strength is decreased. If the surface roughness Ra of the chrome plated layer is greater than 0.3 μm, the surface of the plated layers exhibits an uneven metallic luster. If the thickness of the chrome plated layer is less than 0.2 μm, the film strength of the chrome plated layer as a plated layer is insufficient, whereby the plated layer is easily scratched. If the thickness of the chrome plated layer is greater than 1 μm, the chrome plated layer is easily cracked, whereby the chrome plated layer tends to peel off.

According to a second aspect of the present invention, in the first aspect of the present invention, the chrome plated layer is formed with numerous dents by shot-peening treatment. A surface having numerous dents formed by shot-peening treatment is used as a roughened surface in order to improve adhesion of the coating, whereby a coating film having a satisfactory coating strength is obtained.

In this case, it is important to form numerous dents in a surface and to form a roughened surface by shot-peening, instead of forming a finely roughened surface by scraping or scratching. In a method of forming a finely roughened surface by scraping or scratching (or by grinding), the coating strength is greatly decreased, and the coating layer is not practical.

On the other hand, in a case of forming numerous dents in the chrome plated layer and forming a roughened surface by shot-peening, the above-described decrease in the coating strength is prevented. In forming numerous dents by shot-peening so as to form a roughened surface, while a roughened surface is formed, a hardened layer is formed at the surface of the chrome plated layer. Therefore, shot-peening is useful for obtaining a scratch-resistant golf club shaft.

According to a third aspect of the present invention, the present invention provides a golf club provided with the golf club shaft of the first or the second aspect of the present invention. According to the third aspect of the present invention, a golf club having the advantages of the first or the second aspect of the present invention is obtained.

According to a fourth aspect of the present invention, the present invention provides a production method for a golf club shaft including a base made of a metal material. The production method includes forming a nickel plated layer on the base and forming a chrome plated layer having a thickness of 0.2 to 1 μm on the nickel plated layer. The production method further includes shot-peening the chrome plated layer so as to form numerous dents in the chrome plated layer and to form a surface having a surface roughness Ra of 0.1 to 0.3 μm, and coating the chrome plated layer formed with the numerous dents.

According to the fourth aspect of the present invention, a golf club shaft having the advantages of the second aspect of the present invention is produced.

According to the present invention, in a structure in which a nickel layer and a chrome layer are formed on a surface of a metal golf club shaft and a coating is applied thereon, a high coating strength is reliably obtained.

BRIEF DESCRIPTION OF THE DRAWINGS

FIG. 4A shows a graph therefor, and FIG. 4B shows a table therefor.

PREFERRED EMBODIMENTS OF THE INVENTION

Structure of Golf Club

Figure 1:
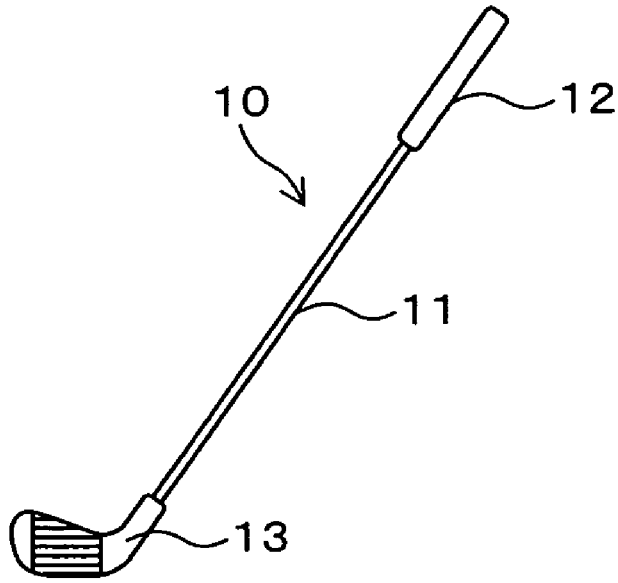
FIG. 1 is a front view showing an example of a golf club.

FIG. 1 is a front view showing an example of a golf club using the present invention. FIG. 1 shows an iron 10 as an example of a golf club. The iron 10 includes a golf club shaft 11, a grip 12 functioning as a portion for gripping, and a head 13 for hitting golf balls. The present invention is applied to the golf club shaft 11. In this case, although an iron is exemplified as a golf club, a wood, a hybrid club, a utility club, and a putter may also be used.

Structure of Golf Club Shaft

Figure 2A:
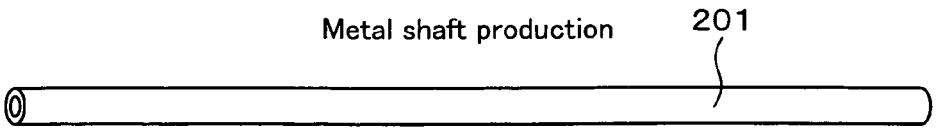
FIGS. 2A to 2D are schematic views describing coating steps.

An example of a golf club shaft using the present invention is shown in FIG. 2A. FIG. 2A shows a golf club shaft 201 having a pipe structure made of a steel and having an outer diameter of approximately 8.5 to 16 mm and a thickness of approximately 0.2 to 0.7 mm. The golf club shaft 201 has a sufficient length required for a golf club. In this case, a straight pipe shape is exemplified, but a structure in which the outer diameter or the wall thickness is varied in the longitudinal direction may be used.

Coating Steps

FIGS. 2A to 2D are schematic views showing an example of coating steps for a golf club shaft using the present invention. First, as shown in FIG. 2A, a metal shaft 201 for a golf club is prepared. The production method for the metal shaft 201 is the same as a conventional production method.

Figure 2B:
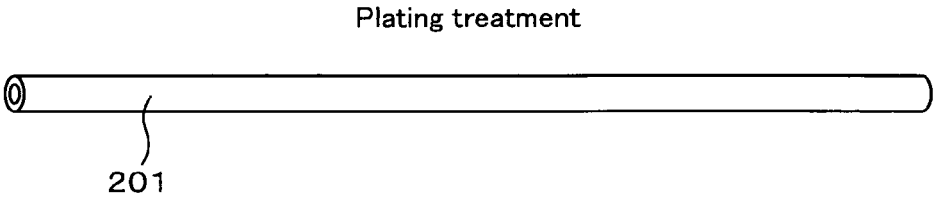

After the metal shaft 201 is obtained, a plating treatment is performed on the surface of the metal shaft 201 (FIG. 2B). In this case, the surface of the metal shaft 201 is cleaned and dried. Then, a semilustrous nickel layer is formed so as to be 7 μm thick by a common electrolytic plating method, and a lustrous nickel layer is formed thereon so as to be 7 μm thick.

Figure 3A:
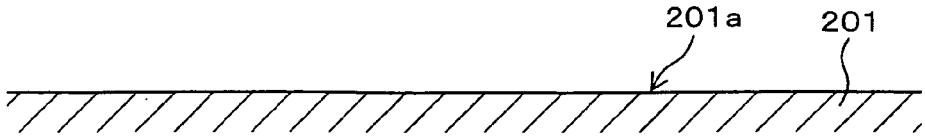
FIGS. 3A to 3D are schematic views describing a plating process and a shot-peening process.
Figure 3B:
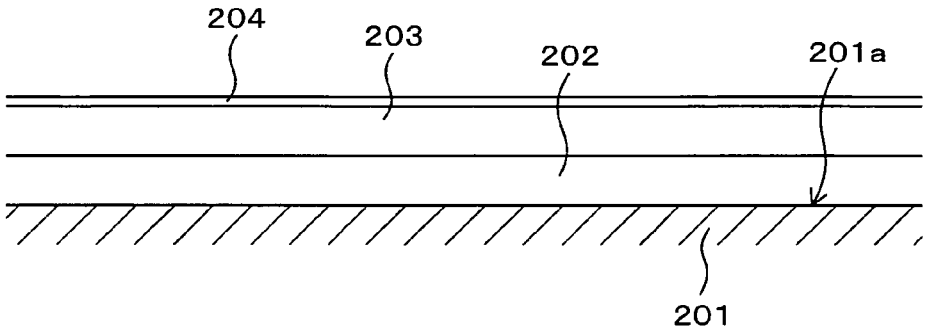

FIGS. 3A to 3D are schematic views showing a plating treatment process. FIG. 3A shows a surface 201*a* of a metal shaft 201 before plating treatment. FIG. 3B shows a metal shaft 201 in which a semilustrous nickel plated layer 202 is formed on the surface 201*a* of the metal shaft 201 and a lustrous nickel plated layer is further formed thereon by an electrolytic plating method. The semilustrous nickel plated layer 202 has a thickness of 7 μm, and the lustrous nickel plated layer has a thickness of 7 μm.

In this case, the semilustrous nickel plated layer is a plated layer made of a nickel not including a sulfur component. The lustrous nickel plated layer is a plated layer made of a nickel including approximately 0.05 weight % of a sulfur component.

By laminating a semilustrous nickel plated layer and a lustrous nickel plated layer, sealing characteristics as a corrosion preventive layer, adhesion with respect to the base (the surface of the metal shaft), and adhesion with respect to a chrome plated layer that will be formed on the lustrous plated layer, are secured with a superior balance.

As shown in FIG. 3B, after the lustrous nickel plated layer 203 is formed, a chrome plated layer 204 is formed on the nickel plated layer 203 so as to be 0.2 to 1 μm thick by a electrolytic plating method. The thickness of the chrome plated layer 204 is set to be 0.2 to 1 μm. If the chrome plated layer 204 has a thickness less than 0.2 μm, the function of the chrome plated layer 204 as a film for protecting the underlying nickel plated layer is reduced, whereby a golf club shaft that can be easily damaged is formed. If the chrome plated layer 204 has a thickness greater than 1 μm, cracking tends to occur in the chrome plated layer 204, and the chrome plated layer 204 easily peels off from the underlying nickel layer.

After the plating treatment shown in FIG. 2B is performed, a shot-peening treatment is performed on the layers plated on the metal shaft 201. In this example, while the metal shaft 201 is rotated, steel particles are sprayed from a nozzle 211 on the metal shaft 201 by air pressure so that the steel particles hit the metal shaft 201 formed with the plated layers. The shot-peening is performed by moving the nozzle 211 in the axial direction of the metal shaft 201, whereby the entire surface of the metal shaft 201 is subjected to the shot-peening. The reference numeral 212 indicates a pipe for pressure-feeding the steel particles to the nozzle 211.

In this case, the shot-peening treatment is performed under the following conditions. The shot ejection pressure is 2.0 kg/cm$^2$, the work rotating rate is 1610 rpm, and the work feeding rate is 30 mm/sec.

As a projection material for the shot-peening, steel beads, glass beads, zirconia beads, etc., may be used. In this example, the shot-peening is performed by using steel beads.

Figure 2C:
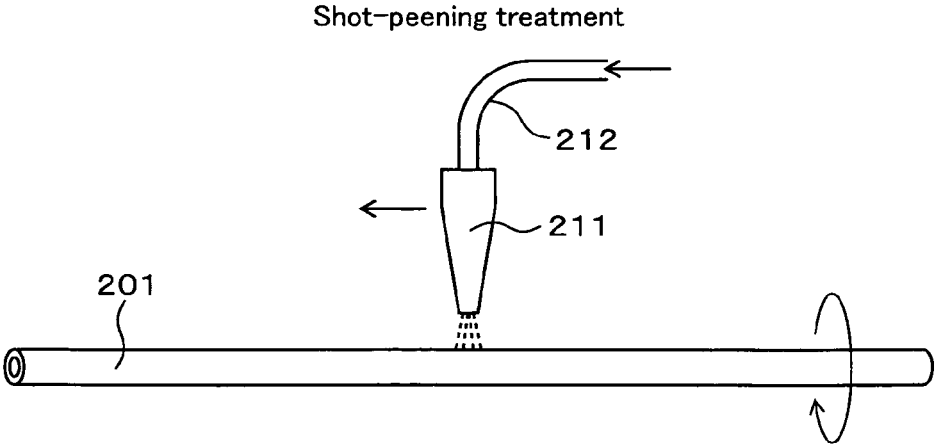
Figure 3C:
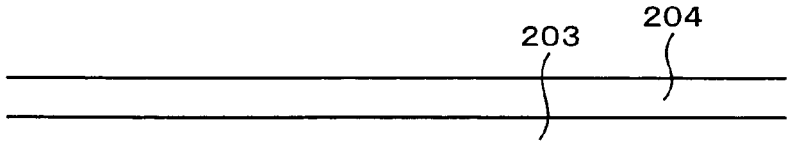

Hereinafter, effects of the shot-peening shown in FIG. 2C are described. FIG. 3C shows a cross section of the lustrous nickel plated layer 203 and the chrome plated layer 204 formed thereon before the shot-peening shown in FIG. 2C is performed.

Figure 3D:
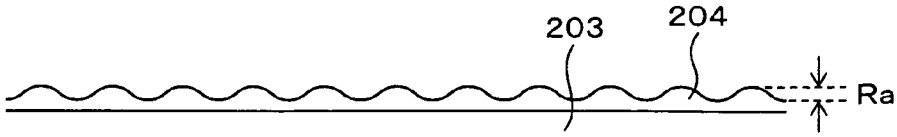

When the shot-peening shown in FIG. 2C is performed under the conditions shown in FIG. 3C, the chrome layer 204 is locally dented numerous times by being hit by the steel balls, whereby a finely dented surface is formed as shown in FIG. 3D. Conditions for the above-described shot-peening are adjusted so that the dented surface has a surface roughness Ra of 0.1 to 0.3 μm.

Figure 2D:
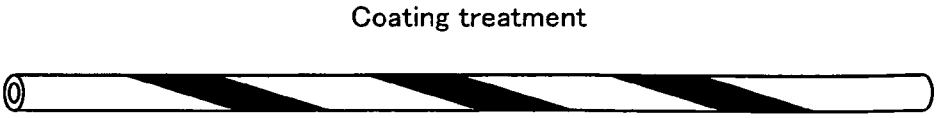

After the shot-peening treatment shown in FIG. 2C is completed, a coating is applied to the dented surface by using a paint so that the shaft has a predetermined design (FIG. 2D). In the coating, a coating layer is formed first as a base layer so that it has a thickness of approximately 10 μm, and a painted layer for forming a predetermined design or a clear layer is formed on the coating layer so that it has a thickness of approximately 10 μm.

For the paint, a urethane resin type, an epoxy resin type, an acrylic resin type, or a polyester type may be used. The coating may be performed by draw coating or spray coating, or by combining these coating methods. In this example, a urethane resin type paint is used, and the coating is performed by a draw coating.

After the coating, the paint is dried, and "curing" is performed. In the curing, the metal shaft 201 is heated to 100° C. and is held for 60 minutes in an atmosphere of air, and the metal shaft 201 is allowed to naturally cool at a room temperature. Thus, for example, a golf club shaft 11 that may be used for a golf club 10 as shown in FIG. 1 is completed.

Evaluations

Figures 4A, 4B:
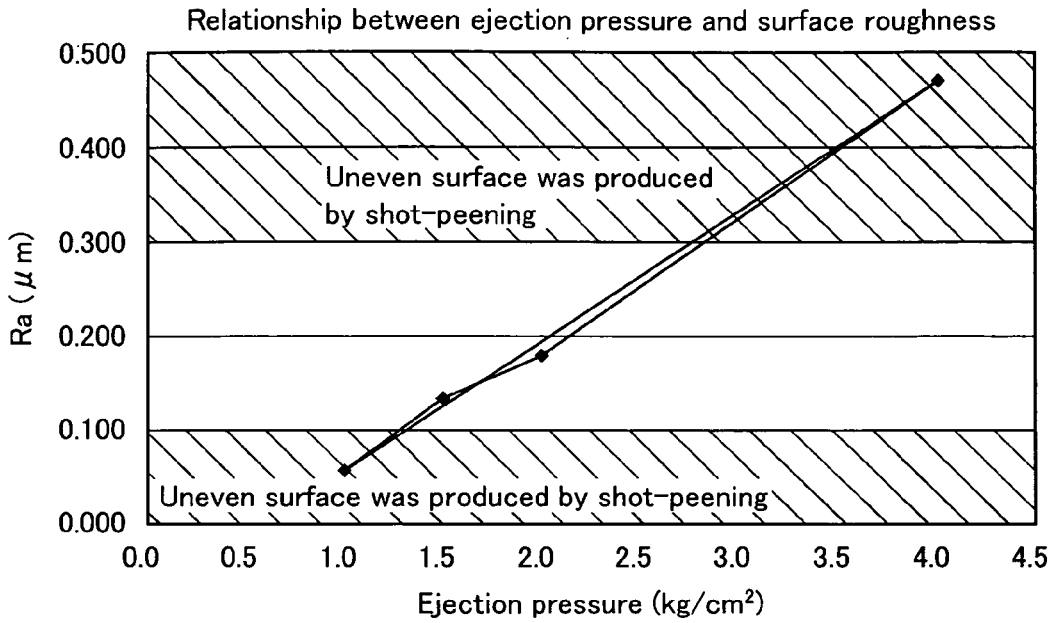
FIGS. 4A and 4B show a relationship between ejection pressure (kg/cm$^2$) of shot-peening and surface roughness Ra (μm)

FIGS. 4A and 4B show a relationship between ejection pressure (kg/cm$^2$) of shot-peening and surface roughness Ra (μm), FIG. 4A is a graph therefor, and FIG. 4B is a table therefor. As is clearly shown in FIGS. 4A and 4B, there is a correlative relationship between the ejection pressure and Ra. In addition, there is a correlative relationship among Ra, unevenness, and coating strength. In this case, the unevenness is defined as color unevenness of the appearance and is a condition in which unexpected color unevenness or a pattern is observed. The surface was determined as being "Unsatisfactory" when the unevenness was observed, and the surface was determined as being Satisfactory" when the unevenness was not observed. For evaluation of coating strength, tests were performed on 25 sampled portions according to a method based on Japanese Industrial Standard K 5600-5-4 (JIS K 5600-5-4). In this case, the coating strength was defined as being "Satisfactory" when no peeling off of the coating was observed, and the coating strength was defined as being "Unsatisfactory" when peeling off of the coating was observed. The observation of the unevenness and the test for the coating strength were performed after a baking step was completed.

As can be understood from FIGS. 4A and 4B, when Ra is in a range of approximately 0.1 to 0.3 μm, the unevenness does not occur, and the coating strength is reliably obtained. That is, in order to reliably obtain the coating strength of a coated portion without deteriorating the metallic luster of the plating, it is effective to perform the shot-peening so that the surface roughness Ra is in a range of 0.1 to 0.3 μm.

In a similar layered structure, when the chrome layer 204 was formed so as to have a surface roughness of 0.1 to 0.3 μm by grinding, instead of the shot-peening, the coating strength was defined as being "Unsatisfactory". This may be because a rough surface of the chrome layer 204 formed by the shot-peening, and a rough surface of the chrome layer 204 formed by grinding, have different effects on the adhesion of a coating layer.

Evaluation Based on EDX

Figure 5A:
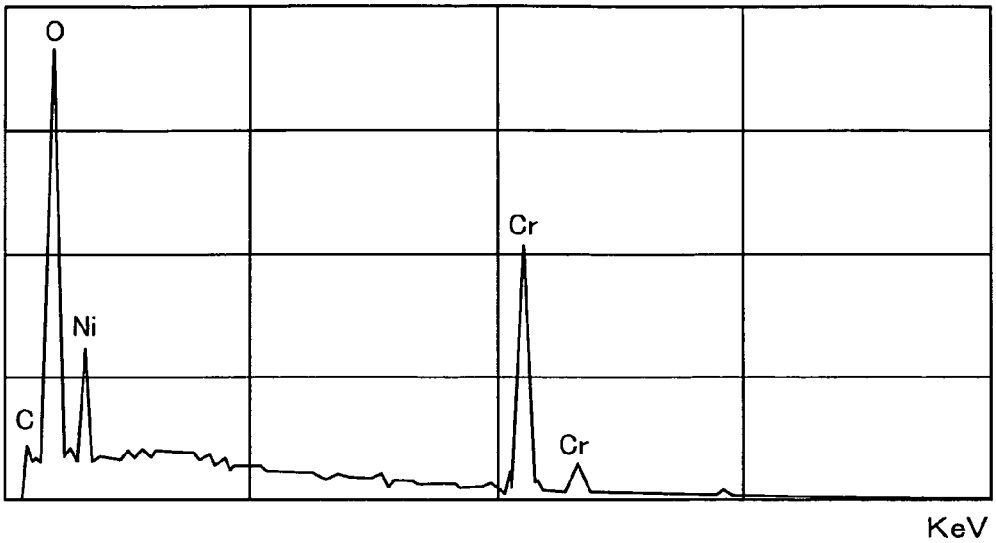
FIGS. 5A and 5B are graphs showing results of EDX analysis.
Figure 5B:
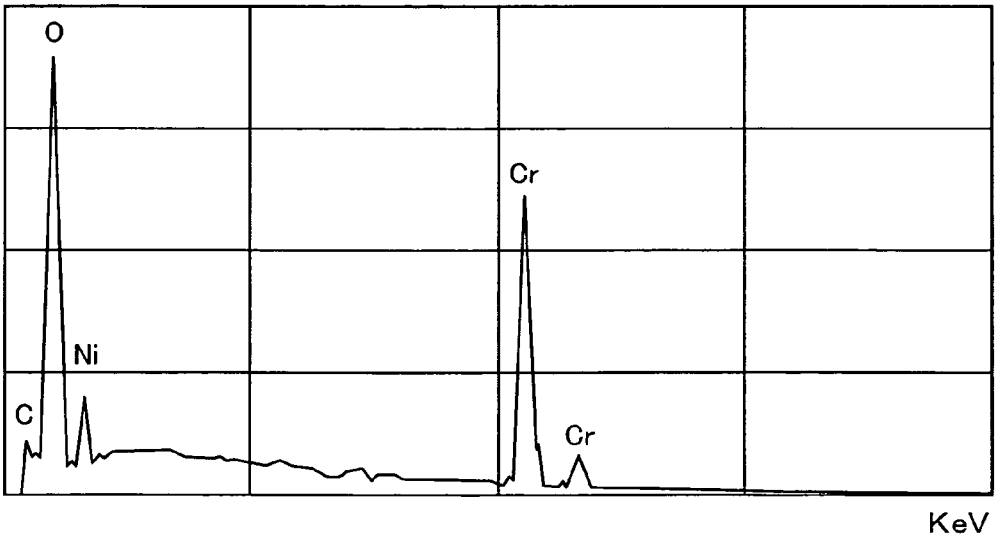

In order to clarify the differences in the effects of roughening performed by the shot-peening and the effects of roughening performed by grinding in a conventional technique, EDX analysis was performed prior to the coating. The results of the EDX analysis are described. In this case, EDX (Energy Dispersive X-ray) is an abbreviation for an energy dispersive fluorescence X-ray analyzer. FIG. 5A is a graph showing a result of observing the surface of a metal shaft 201 by EDX analysis after the shot-peening shown in FIG. 2C was performed (prior to the coating). FIG. 5B is a graph showing a result of observing the surface of a portion by EDX analysis, and the portion was not subjected to the shot-peening.

Figure 6A:
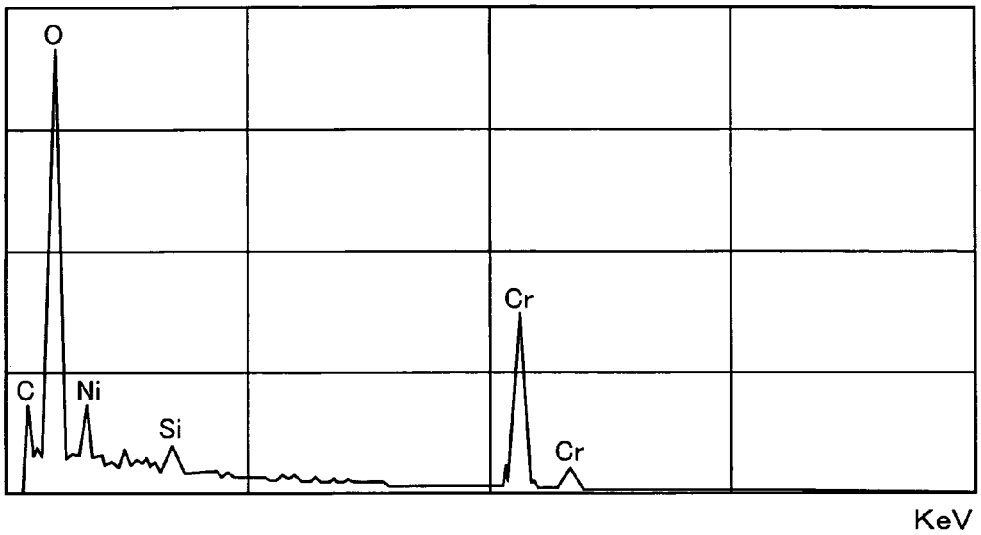
FIGS. 6A and 6B are graphs showing results of EDX analysis.
Figure 6B:
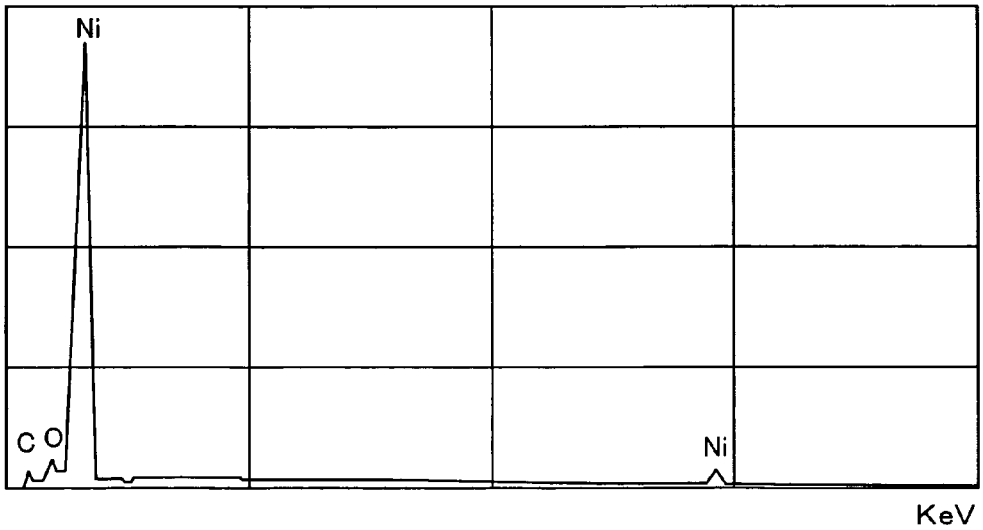

FIGS. 6A and 6B show results of EDX analysis of the surface of a metal shaft 201 before the coating, and the surface was roughened by a conventional grinding, instead of by the shot-peening. FIGS. 6A and 6B are data regarding ground portions that exhibited extremely different results. In this case, FIGS. 5A, 5B, 6A, and 6B show relative values of counted numbers on the longitudinal axis and show the variable on the horizontal axis, and the variable exhibits differences in wavelengths of X-rays that were detected.

In the sample subjected to the shot-peening, no change in color tones of the appearance was perceived, and an even surface was observed. Results of EDX analysis of portions subjected to the shot-peening did not vary greatly, and approximately similar results were obtained from the portions. As can be understood by comparing FIGS. 5A and 5B, by performing the shot-peeing, the peak value of chromium was decreased by approximately 20%, and the peak value of nickel was increased by approximately 50%. This may be because the effect of the underlying nickel plated layer was increased whereas the chrome plated layer at the outermost surface uniformly remained by the shot-peeing.

On the other hand, in the sample subjected to grinding, color tones of the ground portions varied, and an uneven appearance was observed. This result is shown in the results of EDX analysis, and there were portions having extremely different compositions even though the portions were ground, as shown in FIGS. 6A and 6B. That is, the portion that showed the result of FIG. 6A is a portion at which the chrome plated layer remained, and the portion that showed the result of FIG. 6B is a portion at which the chrome plated layer was almost completely peeled off (or cut off). Under observation by a microscope, a portion at which the chrome plated layer was locally peeled off was observed.

FIGS. 5A and 6A clearly show the difference of the effects of the shot-peening and the grinding. That is, as described above, in the shot-peening shown in FIG. 5A, while the peak value of chromium was increased, the peak of the underlying nickel was observed. On the other hand, in the grinding shown in FIG. 6A, the peak value of chromium was small and the peak value of nickel was also small, compared to those in the case of the shot-peening.

According to the above-described results of the observations, the following may be reasons that high coating strength is obtained by performing shot-peening treatment. In the shot-peening treatment, as shown in FIG. 5A, the effect of nickel is increased without decreasing the effect of chromium in the chrome plated layer at the outermost surface. The surface is roughened by forming numerous dents in the chrome plated layer by shot-peening treatment. Therefore, the amount of peeling off of chromium material is small, and portions at which the chrome plated layer was hit are made thinner, whereby the effect of the underlying nickel plated layer is increased.

Since the nickel plated layer tends to adhere to the coating layer compared to the chrome plated layer, the adhesion of the coating layer can be increased by increasing the effect of nickel, as described above. On the other hand, when grinding is performed as shown in FIG. 6A, the effect of the nickel plated layer at portions at which the chrome plated layer remains is relatively small compared to that in a case of performing shot-peening. Therefore, the adhesion of the coating layer is not greatly increased by the effect of the underlying nickel plated layer. In the case of the grinding, the chrome plated layer does not uniformly exist and is locally peeled off. In the vicinity of the boundary between a portion at which the chrome plated layer is peeled off and a portion with the chrome plated layer, the adhesion of the chrome plated layer to the nickel plated layer is decreased. Accordingly, the chrome plated layer may be further peeled off and may be slightly deformed at portions at which the adhesion thereof is deteriorated, whereby the coating film is locally peeled off, and the coating strength is extremely decreased.

That is, in the shot-peening, a surface is roughened by forming numerous dents by hitting the surface with steel balls, instead of peeling off the chrome plated layer. Therefore, while the chrome plated layer uniformly remains, the effect of the underlying nickel layer for improving the adhesion of a coating is obtained, whereby high coating strength is obtained. Moreover, in the shot-peening, since the chrome plated layer can uniformly exist, local peeling off of the coating layer is prevented in baking, whereby coating strength is not greatly decreased.

The present invention may be used for golf club shafts and golf clubs using the golf club shafts.

What is claimed is:

1. A golf club shaft comprising:

a base made of a metal material;

a nickel plated layer formed on the base;

a chrome plated layer formed on the nickel plated layer, the chrome plated layer having a surface roughness Ra of 0.1 to 0.3 μm and a thickness of 0.2 to 1 μm; and a coating layer formed on the chrome plated layer, wherein the chrome plated layer is formed with numerous dents by shot-peening treatment, wherein the nickel plated layer includes a semilustrous nickel plated layer and a lustrous nickel plated layer, with the semilustrous nickel plated layer formed on the base, and the lustrous nickel plated layer formed on the semilustrous nickel plated layer.

2. A golf club comprising the golf club shaft recited in claim 1.

3. The golf club shaft according to claim 1, wherein the coating layer comprises a paint.

4. A golf club comprising the golf club shaft recited in claim 3.

5. The golf club shaft according to claim 3, wherein the paint is a paint selected from the group consisting of a urethane resin paint, an epoxy resin paint, an acrylic resin paint and a polyester paint.

6. The golf club shaft according to claim 1, wherein the coating layer comprises base layer provided on the chrome plated layer, and a painted layer for forming a predetermined design or a clear layer provided on the base layer.

7. The golf club shaft according to claim 1, wherein the semilustrous nickel plated layer is a plated layer made of a nickel not including a sulfur component, and the lustrous nickel plated layer is a plated layer made of a nickel including a sulfur component.

8. The golf club shaft according to claim 1, wherein the coating layer comprises a paint embedded in dents formed by the shot-peening treatment.

* * * * *